United States Patent [19]

Gwilliam

[11] Patent Number: 4,924,773

[45] Date of Patent: May 15, 1990

[54] HAND STAMP WITH RESERVOIR

[76] Inventor: Terri L. Gwilliam, 626 Brown St., Healdsburg, Calif. 95448

[21] Appl. No.: 308,670

[22] Filed: Feb. 10, 1989

[51] Int. Cl.[5] ..... B41K 1/04; B41K 1/52; B05C 1/00; B05C 17/12

[52] U.S. Cl. ..... 101/327; 101/405; 401/25; 401/140; 401/202; 401/207; D18/15

[58] Field of Search ..... 401/196, 199, 207, 23, 401/25, 196, 261, 262, 16, 35, 36, 48, 140, 202; 101/327, 368, 405, 406; 400/464; D18/14–16, 18; 118/216, 255, 264, 268; 40/328; 273/269

[56] References Cited

U.S. PATENT DOCUMENTS

| | | | |
|---|---|---|---|
| 272,443 | 2/1883 | Ingersoll | 101/406 |
| 2,176,160 | 10/1939 | Uhl, Jr. | 101/405 X |
| 2,316,040 | 4/1943 | Wirfel | 401/196 X |
| 2,347,996 | 5/1944 | Doerrler | 101/327 |
| 4,183,328 | 1/1980 | Lawrence | 401/196 X |
| 4,187,772 | 2/1980 | Hollenbeck | 101/406 X |
| 4,452,142 | 6/1984 | Eckels | 101/405 X |

FOREIGN PATENT DOCUMENTS

| | | | |
|---|---|---|---|
| 668916 | 3/1952 | United Kingdom | 101/327 |
| 857968 | 1/1961 | United Kingdom | 401/196 |

OTHER PUBLICATIONS

"Hand Stamps", Walter Aberth, a published abstract, Official Gazette, vol. 645, page 682, Apr. 10, 1951.

*Primary Examiner*—Richard J. Apley
*Assistant Examiner*—David F. Crosby
*Attorney, Agent, or Firm*—Jerry T. Kearns

[57] ABSTRACT

A bingo ink marker has an elongated handle connected to a cubical ink reservoir. The cubical ink reservoir has six faces with a threaded tubular sleeve extending from each face. A sponge applicator is removably received in each of the threaded sleeve and each is configured to produce a different design ink mark. A plurality of threaded caps are provided for selectively covering each of the applicators. One of the threaded caps includes an attached elongated handle portion. In use, the user may index the cubical ink reservoir to utilize any of the six differently designed applicators.

2 Claims, 4 Drawing Sheets

HAND STAMP WITH RESERVOIR

BACKGROUND OF THE INVENTION

1. Field of the Invention

The present invention relates to marking devices, and more particularly pertains to a new and improved bingo marker for use in placing ink spots on bingo cards. The game of bingo is tremendously popular and a wide variety of commercial bingo daubers are available for marking bingo cards. The conventional bingo dauber utilizes a round sponge rubber ink applicator in fluid communication with an ink reservoir. A typical individual playing bingo places great reliance upon the elements of luck and chance. These individuals enjoy the use of lucky charms and symbols including dollar signs, hearts, four leaf clovers, etc. In order to add increased enjoyment to the game of bingo for these individuals, the present invention provides a specially designed ink marker which utilizes replaceable sponge applicators configured to produce various different designed ink marks.

2. Description of the Prior Art

Various types of marking devices are known in the prior art. A typical example of such a marking device is to be found in U.S. Pat. No. 2,453,201, which issued to J. Cushman on Nov. 9, 1948. This patent discloses an ink marking device including an elongated cylindrical reservoir having a socket for removably receiving an applicator tip selected from a set of differently designed marking tips. U.S. Pat. No. 2,873,464, which issued to S. Rosenthal on Feb. 17, 1959, discloses a marking device for applying ink upon a surface to be stenciled which includes an elongated handle including an interior tubular ink reservoir. A fibrous applicator is secured by a threaded connection to the handle portion. U.S. Pat. No. 3,006,024, which issued to E. Nelson et al on Oct. 31, 1961, discloses a marking device which includes a cylindrical fabric applicator secured to a threaded cap for mounting upon the threaded neck of a paint reservoir. U.S. Pat. No. 4,050,826, which issued to W. Berghahn on Sept. 27, 1977, discloses a liquid applicator having a cylindrical liquid reservoir fitted with a hemispherical applicator formed from a sintered porous synthetic plastic resin. U.S. Pat. No. 4,643,426, which issued to D. Adams on Feb. 17, 1987, discloses a dual purpose game playing magnetic wand having one end formed as a magnetized extension for selectively removing ferromagnetic game pieces from a playing board while the handle or other end of the wand is hollow having a wick and marking fluid therein to be used for permanently marking a game playing board when desired.

While the above mentioned devices are suited for their intended usage, none of these devices disclose the use of a bingo game ink marker utilizing replaceable applicators selected from a set of differently designed applicators. An additional feature of the present invention, not contemplated by the aforesaid prior art devices, is the provision of a cubical ink reservoir having six faces each bearing a differently designed ink applicator. None of aforesaid prior art devices contemplate the use of such an indexable marker for producing differently designed marks on bingo game cards. Inasmuch as the art is relatively crowded with respect to these various types of marking devices, it can be appreciated that there is a continuing need for and interest in improvements to such marking devices, and in this respect, the present invention addresses this need and interest.

SUMMARY OF THE INVENTION

In view of the foregoing disadvantages inherent in the known types of marking devices now present in the prior art, the present invention provides an improved marking device. As such, the general purpose of the present invention, which will be described subsequently in greater detail, is to provide a new and improved marking device which has all the advantages of the prior art marking devices and none of the disadvantages.

To attain this, representative embodiments of the concepts of the present invention are illustrated in the drawings and make use of a bingo ink marker having an elongated handle connected to a cubical ink reservoir. The cubical ink reservoir has six faces with a threaded tubular sleeve extending from each face. A sponge applicator is removably received in each of the threaded sleeve and each is configured to produce a different design ink mark. A plurality of threaded caps are provided for selectively covering each of the applicators. One of the threaded caps includes an attached elongated handle portion. In use, the user may index the cubical ink reservoir to utilize any of the six differently designed applicators.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved marking device which has all the advantages of the prior art marking devices and none of the disadvantages.

It is another object of the present invention to provide a new and improved marking device which may be easily and efficiently manufactured and marketed.

It is a further object of the present invention to provide a new and improved marking device which is of a durable and reliable construction.

An even further object of the present invention is to provide a new and improved marking device which is susceptible of a low cost of manufacture with regard to both materials and labor, and which accordingly is then susceptible of low prices of sale to the consuming public, thereby making such marking devices economically available to the buying public.

Still yet another object of the present invention is to provide a new and improved marking device which provides in the apparatuses and methods of the prior art some of the advantages thereof, while simultaneously overcoming some of the disadvantages normally associated therewith.

Still another object of the present invention is to provide a new and improved game marker for use in playing bingo which utilizes replaceable applicators selected from a set of applicators each configured for producing a differently designed ink mark on a bingo game card.

Yet another object of the present invention is to provide a new and improved ink marker for use in playing bingo which allows an individual to select from a wide variety of differently designed applicators.

Even still another object of the present invention is to provide a new and improved marker for use in playing bingo which combines six differently designed applicators in an integral unit for selective use by a bingo player.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
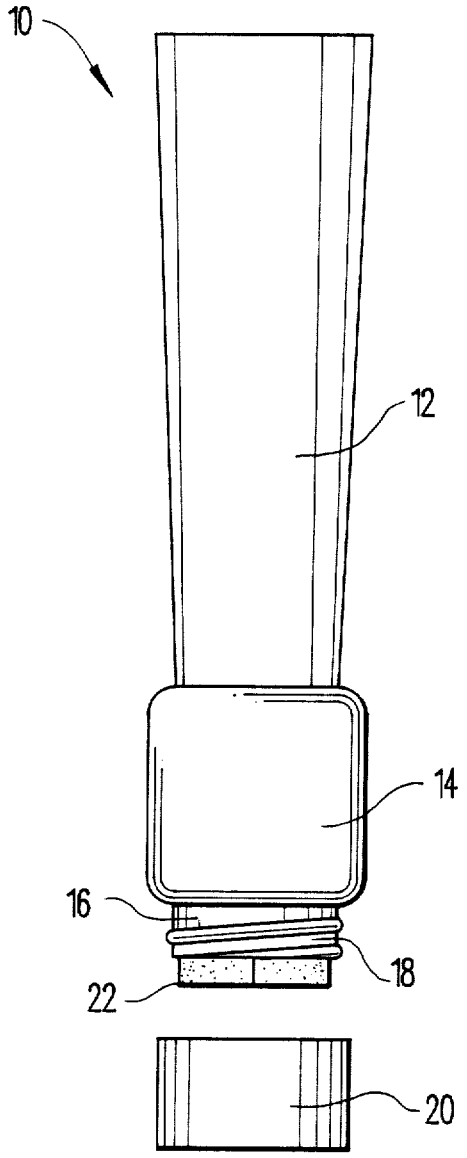
FIG. 1 is a side view illustrating the marking device according to the first embodiment of the present invention, with the cap removed.

With reference now to the drawings, and in particular to FIG. 1 thereof, a new and improved marking device embodying the principles and concepts of the present invention and generally designated by the reference numeral 10 will be described.

More specifically, it will be noted that the first embodiment 10 of the invention includes an elongated handle portion 12 connected to a hollow cubical ink reservoir 14. A tubular sleeve 16 extends from a bottom face of the reservoir 14 and is provided with external threads 18 for engagement with internal threads provided in a hollow cylindrical threaded cap 20. A sponge type ink applicator 22 is removably received within the sleeve 16 and is configured to produce a predetermined design ink spot on a bingo card.

Figure 2:
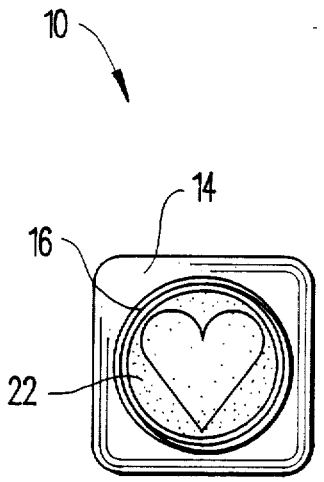
FIG. 2 is an end view of the marking device according to the first embodiment of the present invention, with the cap removed.

FIG. 2 provides an end view which illustrates an example heart-shaped design which may be formed on the applicator 22.

Figure 3:
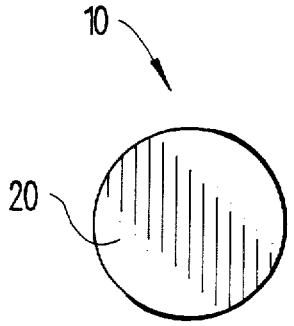
FIG. 3 is an end view of the removable cap.

FIG. 3 depicts an end view of the cap 20 which illustrates the cylindrical nature thereof.

Figure 4:
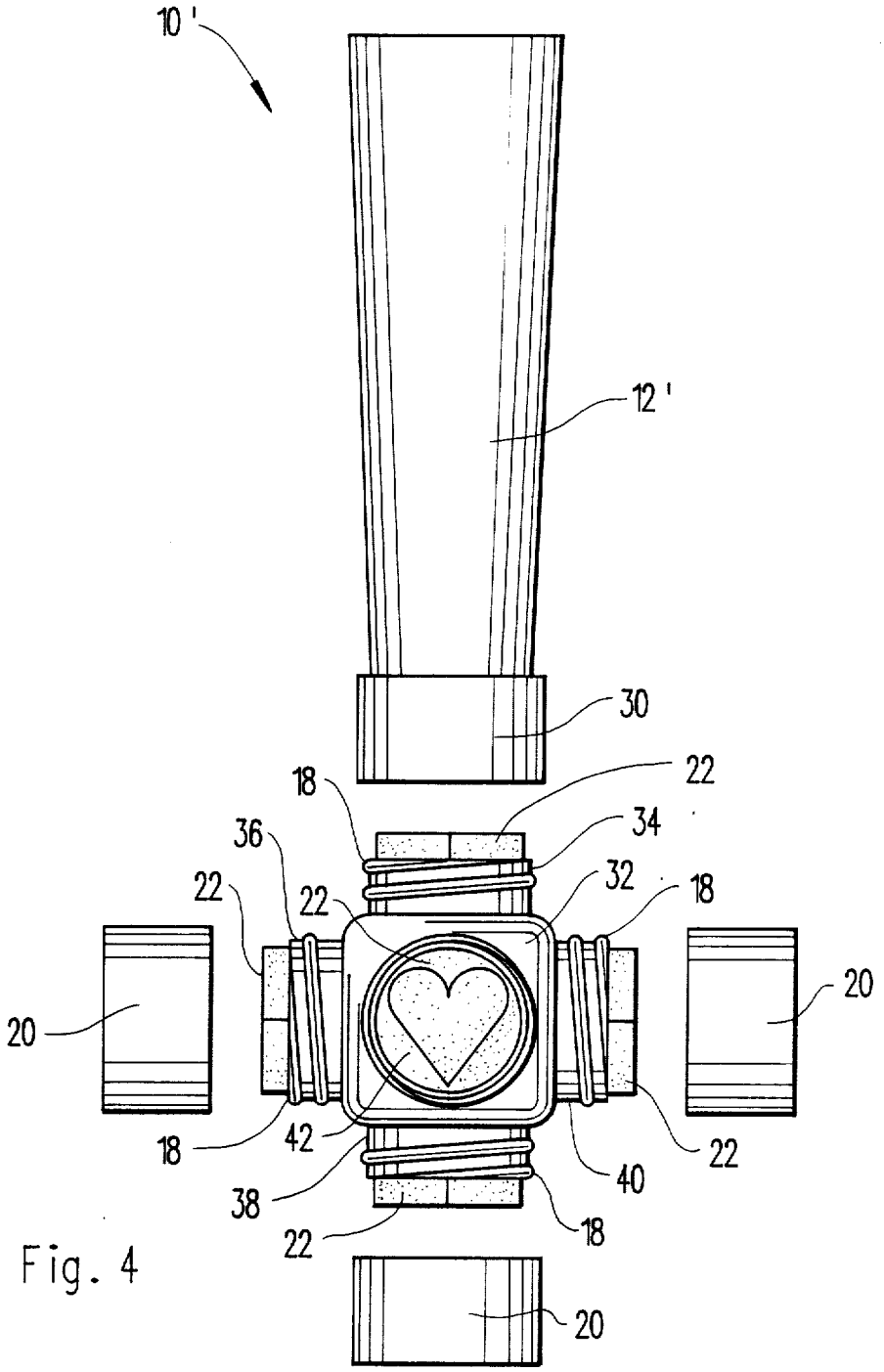
FIG. 4 is an exploded side view illustrating the indexable marking device according to the second embodiment of the present invention.
Figure 5:
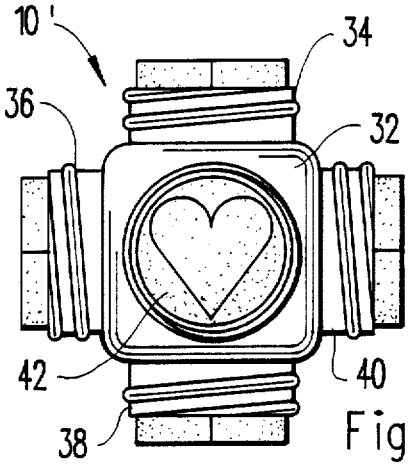
FIG. 5 is a front view of the ink reservoir of the marking device according to the second embodiment of the present invention.
Figure 6:
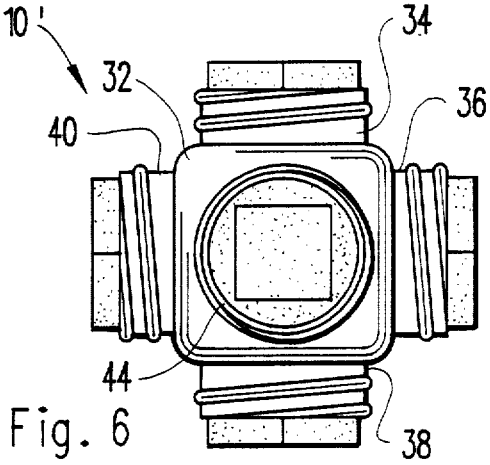
FIG. 6 is a back view of the ink reservoir.
Figure 7:
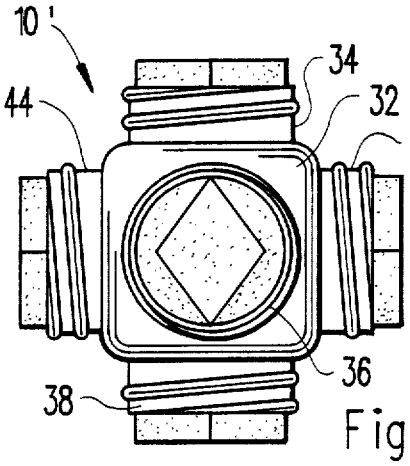
FIG. 7 is a left side view of the ink reservoir.
Figure 8:
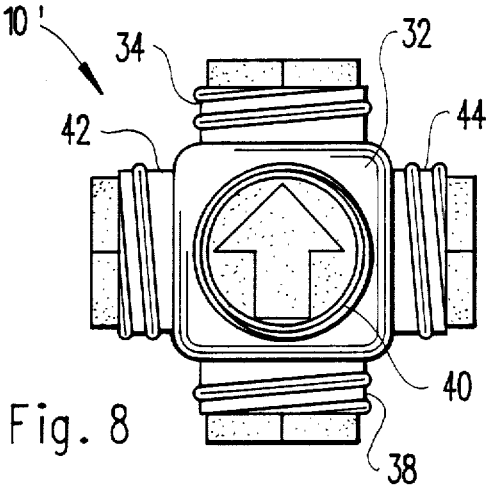
FIG. 8 is a right side view of the ink reservoir.
Figure 9:
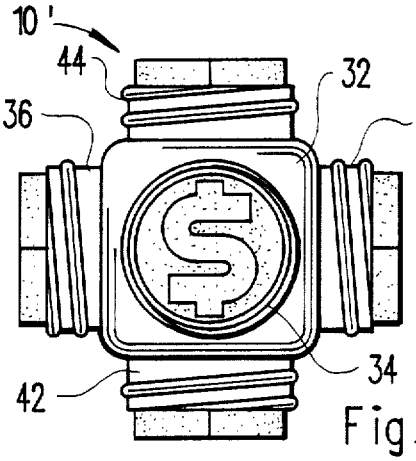
FIG. 9 is a top view of the ink reservoir.
Figure 10:
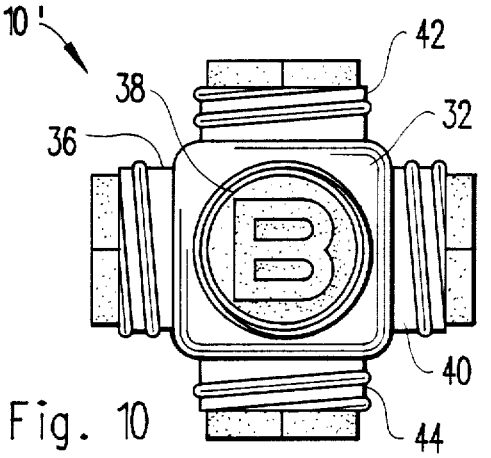
FIG. 10 is a bottom view of the ink reservoir.

FIG. 4 illustrates a second embodiment 10' of the present invention which includes an elongated handle 12' terminating in a cylindrical internally threaded cap 30. A cubical hollow ink reservoir 32 has six faces each having a tubular threaded sleeve extending therefrom. Each of the threaded sleeves removably retains a sponge rubber type applicator 22 configured to produce a particular design of ink spot. The threaded sleeves have been designated by the reference numerals 34, 36, 38, 40, 42 and 44 (not shown). Identical internally threaded removable caps 20 are provided for engagement with the external threads 18 on the various tubular sleeves. This allows all of the applicators 22 to be covered when not in use. To utilize a particular applicator, the cap 30 is placed into engagement with the threaded sleeve extending from the opposite face of the ink reservoir to that of the desired applicator. For example, in the illustrated configuration, the cap 30 attached to the handle 12' will be secured on the sleeve 34. The remaining caps 20 will be placed into engagement with remaining tubular sleeves and the cap 20 will be removed from the sleeve 38, thus exposing the bottom applicator 22 for use. To facilitate the selection of the desired applicator design, each of the caps 20 may have a representation of the design designated on the exposed end face of the cap, or each of the caps 20 may be formed from a transparent material to enable direct viewing of the designs on the applicators 22. In either case, an individual has convenient access to six differently designed markers for use in marking bingo cards all contained in a single integral and easily transportable marker.

FIGS. 5 through 10 respectively illustrate the applicator designs on the front, back, left, right, top and bottom faces of the cubical ink reservoir 32. It should be understood that the illustrated applicator designs are exemplary only and a wide variety of other designs may be utilized.

Figure 11:
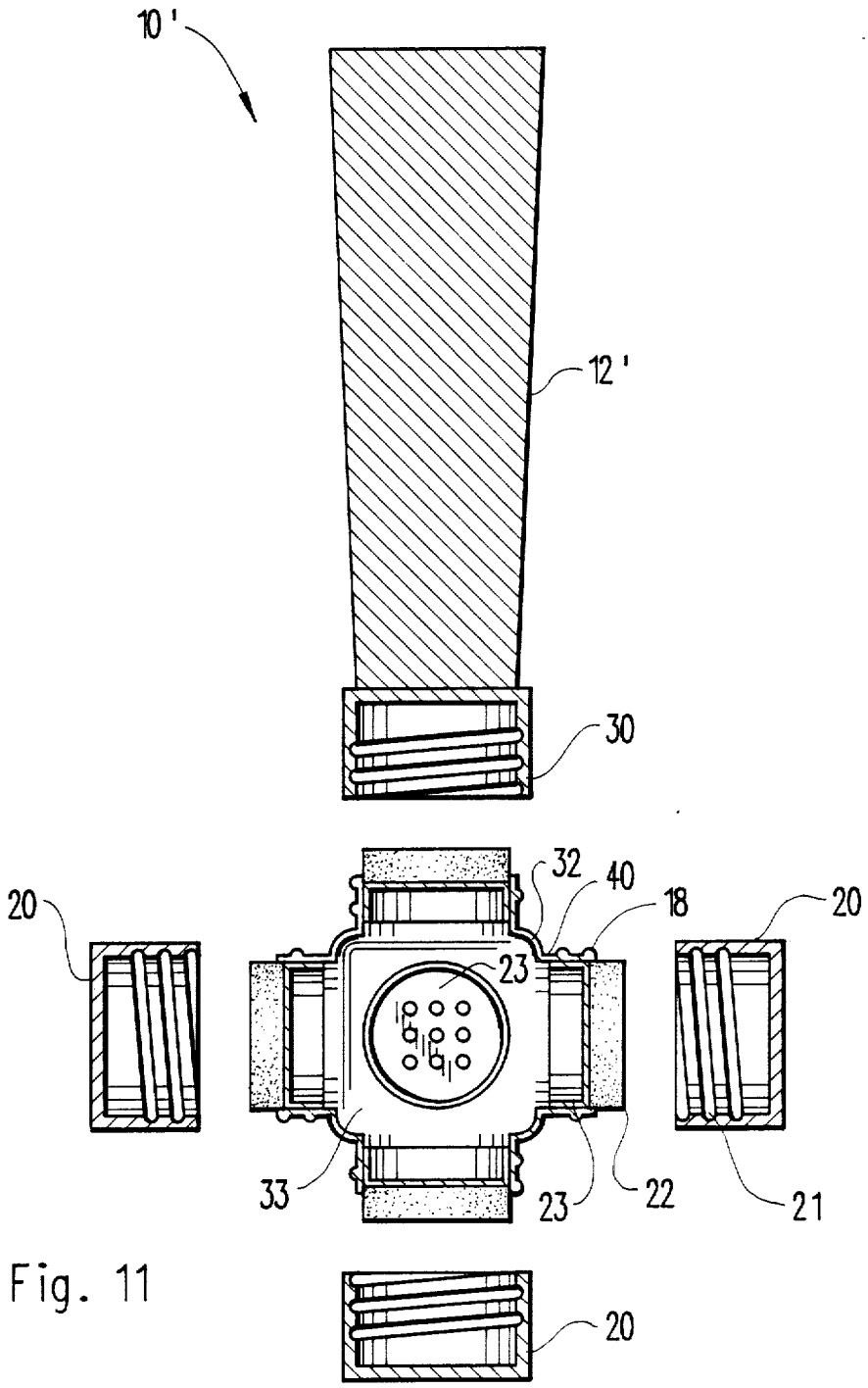
FIG. 11 is an exploded cross sectional view, illustrating the internal construction of the marking device according to the second embodiment of the present invention.

FIG. 11 provides an exploded cross sectional diagrammatic view which illustrates the internal construction of the marking device 10'. The ink reservoir 32 is formed as a hollow cube and has a tubular sleeve extending from each of the six faces. As previously described, each of the tubular sleeves is in fluid communication with the interior 33 of the ink reservoir 32. Each of the applicators 22 is mounted on a cylindrical perforated carrier 23 which is frictionally retained within the tubular sleeve 40. In use, ink from the interior 33 of the reservoir 32 is communicated to the sponge type ink applicator 22. When not in use, engagement of the internal threads 21 on the cap 20 with the external threads 18 on the sleeve 40 effectively seals the applicator 22. By engagement of five of the caps 20 and the cap 30 on the six tubular sleeves extending from each of the six faces of the cubical ink reservoir 32, the entire ink reservoir is sealed. The carrier members 23 and attached applicator 22 may be removed from the tubular sleeve 40 to allow filling of the reservoir 32 and to allow replacement of the applicator 22 with a differently designed applicator.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A marking device for use in playing bingo, comprising:
- a cubical ink reservoir having six faces;
- a tubular threaded sleeve extending from each of said six faces;
- a sponge applicator removably received in each of said sleeves and in fluid communication with said ink reservoir;
- each of said applicators configured for forming a different design ink mark;
- a removable threaded cap for selectively covering each of said applicators; and
- an elongated handle connected to one of said caps.

2. A marking device for use in playing bingo, comprising:
- a cubical ink reservoir having six faces;
- a tubular sleeve extending from each of said six faces;
- a sponge applicator removably received in each of said sleeves and in fluid communication with said ink reservoir;
- each of said applicators configured for forming a different design ink mark;
- a removable cap for selectively covering each of said applicators; and
- an elongated handle connected to one of said caps.

* * * * *